US010060158B2

(12) United States Patent
Frolov et al.

(10) Patent No.: US 10,060,158 B2
(45) Date of Patent: Aug. 28, 2018

(54) RIM EXIT DEVICE WITH SPLIT LATCH

(71) Applicants: George Frolov, Farmington, CT (US); James J. Scott, New Britain, CT (US)

(72) Inventors: George Frolov, Farmington, CT (US); James J. Scott, New Britain, CT (US)

(73) Assignee: George Frolov, Farmington, CT (US)

( * ) Notice: Subject to any disclaimer, the term of this patent is extended or adjusted under 35 U.S.C. 154(b) by 880 days.

(21) Appl. No.: 14/522,939

(22) Filed: Oct. 24, 2014

(65) Prior Publication Data

US 2015/0115624 A1 Apr. 30, 2015

Related U.S. Application Data

(60) Provisional application No. 61/895,165, filed on Oct. 24, 2013.

(51) Int. Cl.

*E05B 65/10* (2006.01)
*E05B 47/00* (2006.01)
*E05B 63/14* (2006.01)

(52) U.S. Cl.

CPC ..... *E05B 47/0012* (2013.01); *E05B 63/14* (2013.01); *E05B 65/10* (2013.01); *E05B 65/1053* (2013.01); *E05B 2047/0016* (2013.01); *E05B 2047/0031* (2013.01); *E05B 2047/0094* (2013.01); *Y10T 292/0962* (2015.04)

(58) Field of Classification Search

CPC ..... Y10T 292/08; Y10T 292/0801; Y10T 292/0834; Y10T 292/0837; Y10T 292/084; Y10T 292/0844; Y10T 292/0908; Y10T 292/0909; Y10T 292/091; Y10T 292/96; Y10T 70/5159; Y10T 292/1021; Y10T 70/7051; Y10T 70/7062; Y10T 70/7107; Y10T 70/7113; Y10T 70/713; Y10T 70/8946; Y10T 70/7073; Y10T 70/7124; Y10T 70/7102; Y10S 292/65; E05B 47/00; E05B 47/0001; E05B 47/0012; E05B 2047/0016; E05B 2047/0036; E05B 2047/0031; E05B 2047/0094; E05B 55/06; E05B 63/14; E05B 65/10; E05B 65/108; E05B 65/1053; E05B 2047/0073; E05B 2047/0074; E05B 2047/0084;

(Continued)

(56) References Cited

U.S. PATENT DOCUMENTS 3,677,043 A * 7/1972 Cox ..... E05B 47/00 70/92
3,801,144 A * 4/1974 Diehl ..... E05B 47/00 292/92

(Continued)

FOREIGN PATENT DOCUMENTS

GB 2330375 A * 4/1999 ..... E05B 47/0603

*Primary Examiner* — Alyson Marie Merlino
(74) *Attorney, Agent, or Firm* — Alix, Yale & Ristas, LLP

(57) ABSTRACT

An exit device employs a pair of projectable latches which are retractable by depressing a push pad. A latch actuator is mounted between the latches and is actuatable to retract the latches. In one embodiment, the actuator comprises a pair of solenoids controlled from a remote location. In another embodiment, the actuator comprises a motor which is activatable from a remote location for unlatching the door. In addition an exterior operator is mountable and connectable to the latch actuator to provide controlled access from the exterior of the door.

8 Claims, 12 Drawing Sheets

(58) Field of Classification Search
CPC ..... E05B 2047/0086; E05B 47/06; E05B 47/0603; E05B 47/0673; E05B 47/026
See application file for complete search history.

(56) References Cited

U.S. PATENT DOCUMENTS

| | | | | | |
|---|---|---|---|---|---|
| 3,873,141 | A * | 3/1975 | Peterson | E05B 65/1066 | 292/92 |
| 4,145,900 | A * | 3/1979 | Ohno | E05B 65/104 | 292/92 |
| 4,961,330 | A * | 10/1990 | Evans | E05B 47/0603 | 292/92 |
| 5,715,715 | A * | 2/1998 | Nunez | E05B 47/0012 | 292/144 |
| 5,876,073 | A * | 3/1999 | Geringer | E05B 47/0673 | 292/144 |
| 2004/0099026 | A1* | 5/2004 | Nunez | E05B 47/0673 | 70/283 |
| 2011/0079057 | A1* | 4/2011 | Frolov | E05B 47/0673 | 70/91 |
| 2012/0025984 | A1* | 2/2012 | Lu | E05B 45/06 | 340/542 |
| 2012/0175892 | A1* | 7/2012 | Shen | E05B 47/0673 | 292/92 |
| 2012/0242092 | A1* | 9/2012 | Frolov | E05B 47/026 | 292/92 |
| 2014/0165669 | A1* | 6/2014 | Tien | E05B 53/00 | 70/91 |

* cited by examiner

RIM EXIT DEVICE WITH SPLIT LATCH

BACKGROUND

This disclosure relates generally to exit devices mountable to doors. More particularly, this disclosure relates to extra heavy duty exit devices which are electrically controlled from a remote location.

Numerous exit devices have been introduced for mounting to exit doors and for controlling the latching of the door and the entrance through the doorway. Such exit devices have latches and operators of a multitude of forms. Some exit devices can be used in connection with multi-point latches which are connected by extension rods. In addition, there are numerous exit devices which have electrical locking features and employ solenoids or motors to provide for locking from a remote location.

It is advantageous to provide an exit device which can readily incorporate various locking functions from a remote location as well as a locking device which has an efficient form with a minimal number of locking points. It is also highly advantageous to provide an exit device which is readily coordinated with an outside trim operator for either electrical or mechanical locking while the push pad is free to retract the latches for egress. In addition, it is highly advantageous that an exit device provide an electrical locking and unlocking for the exterior side of the door which is backed up by an optional mechanical key override.

SUMMARY

Briefly stated, an exit device in a preferred form comprises a push bar adapted for mounting to the inside of an exit door. The push bar has a depressible push pad. A pair of projectable latches are separated by a central cavity. The latches are biased to a projected position and retractable by depressing the push pad. A double strike is mountable to the frame of a door and engageable by the latches for retaining the door in a latched position. A latch actuator mounted in the central cavity is actuatable to retract the latches. An exterior operator is mountable to an exterior side of the door and connectable to the latch actuator. The exterior operator is operable to provide controlled access from the exterior of the door.

In one embodiment, the latch actuator comprises at least one solenoid controlled from a remote location. In another embodiment, the latch actuator comprises a motor which is activatable from a remote location. The exterior operator is preferably operable via a key or a handle lever.

The push pad operatively connects with the latch actuator and each of the projectable latches has an associated arm which follows a cam track. The latches are activatable by the pull plate whereby each latch is retracted upon depressing the push pad.

A pair of solenoids is mounted in the central cavity and actuatable from a remote location for retraction of the latches. The external operator connects via a spindle with the latch actuator. The spindle rotates a cam to move the pull plate to retract the latches.

In one embodiment, a motor couples to a spring drive and a locking slide having a locking pin. The locking pin is receivable in a locking slot of the locking disk. The motor pushes the locking pin into the locking slot or retracts the locking pin from the locking slot. An override disk is driven by an override blade. The locking disk has a peripheral override slot. The override disk is free to rotate as allowed by the travel of an override pin in the override slot. Free rotation of the override disk allows an override cam with a follower built into the locking slide to push out the locking pin attached to the locking slide.

An exit device comprises a push bar adapted to the inside of an exit door. The push bar has a depressible push pad which retracts a pull plate. A pair of projectable and retractable latches are each at least partially mounted in a housing and separated by a central cavity. Each of the latches has a crank arm which follows a cam track and is activatable by the pull plate and is retractable by depressing the push pad. The locking disk connects to a cam and has a locking slot and an override slot. A double strike is mountable to the frame of a door and engageable by the latches for retaining the exit door in a latched position. A latch actuator mounted in the central cavity comprises a remotely controlled device operatively connected to a locking slide which has a locking pin. The actuator is actuatable to retract the latches by pushing the locking pin into the locking slot. The latch actuator is also actuatable for retracting the locking pin from the slot. An exterior operator is mountable to an exterior side of the door and connectable to the latch actuator via a spindle which rotates the cam to move the pull plate. The operator is operable to provide controlled access from exterior of the door.

In one embodiment, the remotely controlled device is a motor coupled to a spring device and is activatable from a remote location for unlatching the door. The remotely controlled device may also be a solenoid or a pair of solenoids.

An exit door installation comprises a door frame and an exit door having an exterior side and an interior side. An exit door latching assembly comprises a push bar mounted to the interior side of the exit door. The push bar has a depressible push pad which retracts a pull plate. A pair of projectable and retractable latches are at least partially mounted in a housing and are separated by a central cavity. Each latch has a crank arm activatable by the pull plate and retractable by depressing the push pad. A locking disk is connected to a cam and has a locking slot and an override slot. A double strike is mounted to the frame of the door and is engageable by the latches for retaining the exit door in a latched position. A latch actuator comprises a remotely controlled device operatively connected to a locking slide having a locking pin. The latch actuator is mounted in a central cavity and actuatable to retract the latches by pushing the locking pin into the locking slot. An exterior operator is mounted to the exterior side of the door and is connectible through the door to the latch actuator via a spindle which rotates the cam to move the pull plate. The latch actuator is activated to provide controlled access from the exterior of the door.

DETAILED DESCRIPTION

With reference to the drawings wherein like numerals represent like parts throughout the figures, a rim exit device which employs a central split latch function is generally designated by the numeral 10. The rim exit device 10 interacts with a corresponding strike assembly 12 which has a double strike configuration to accommodate the dual latch function. The rim exit device 10 produces a holding force of high integrity and is capable of being modified to provide various options for remote electrical locking as well as mechanical locking. The rim exit device 10 is readily operable from the interior space by means of a push pad which is always free to retract the latches and to permit egress from the controlled space. Electrical locking and unlocking can be provided by various forms and is also capable of being backed up by various optional mechanical key overrides, as will be further described.

Figure 1:
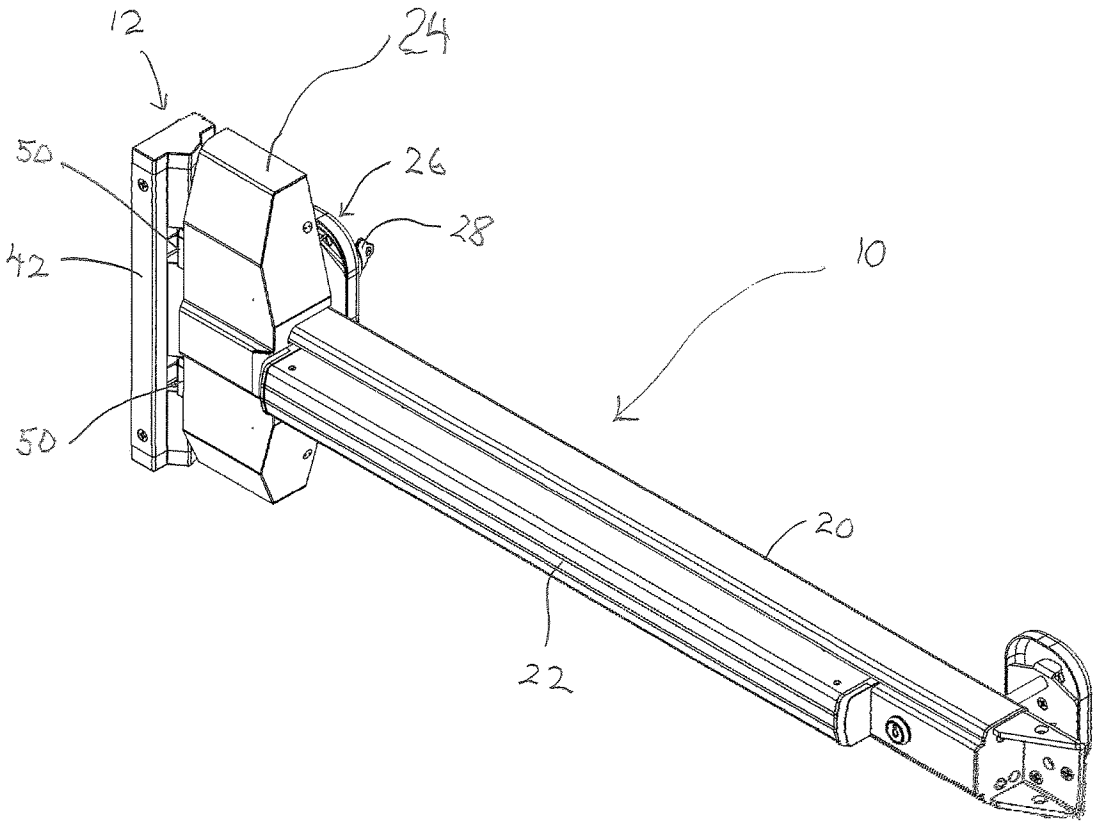
FIG. 1 is a perspective view of a rim exit device with split latches and an associated double-strike.
Figure 2:
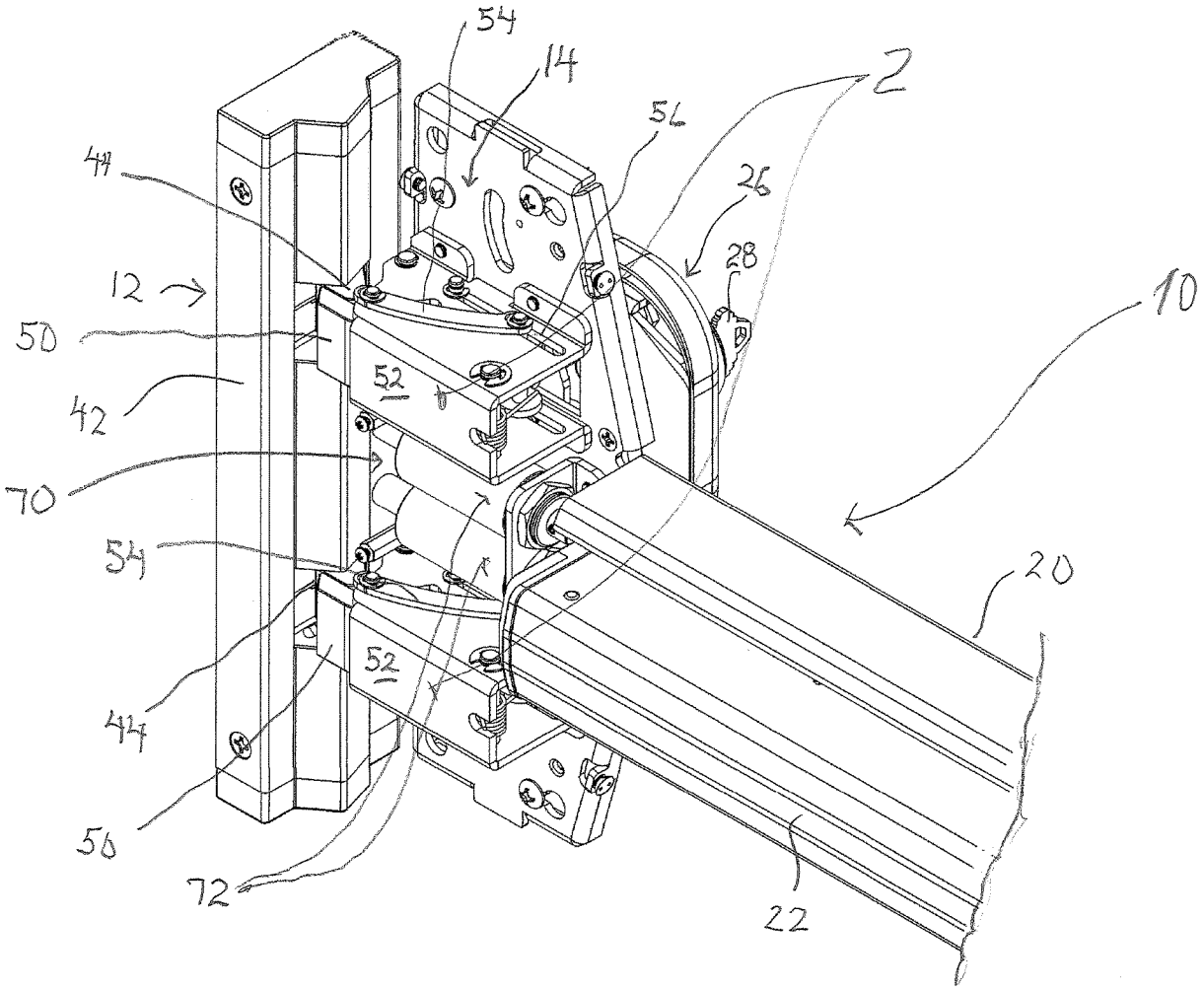
FIG. 2 is a fragmentary perspective view, portions removed, of the rim exit device and strike of FIG. 1.
Figure 3:
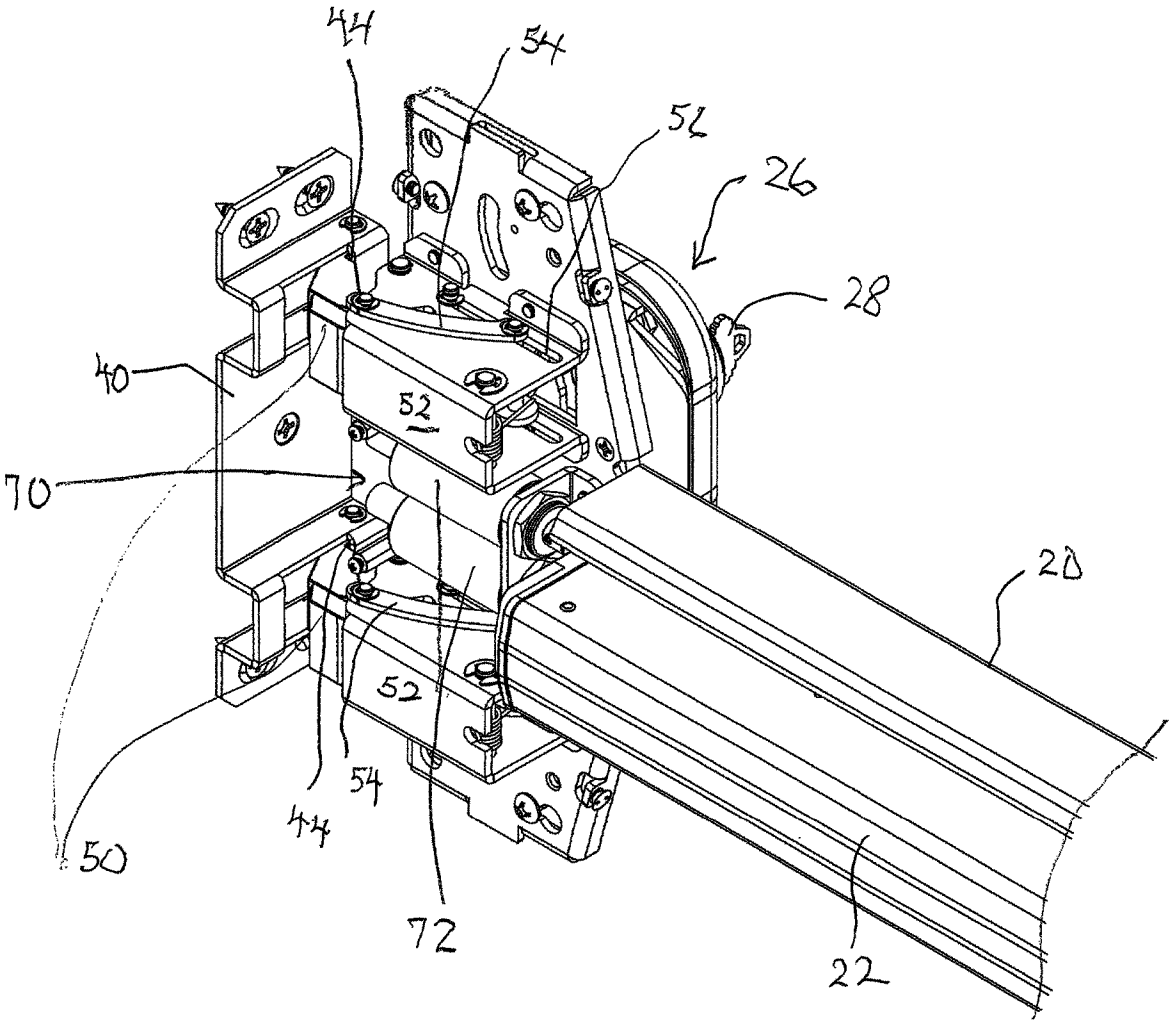
FIG. 3 is a fragmentary perspective view of the rim exit device and strike of FIG. 2 wherein additional portions are removed from the strike.

With reference to FIG. 1, the rim exit device 10 includes an elongated base 20 which receives a push pad 22. A split dual latch assembly 14 includes a cover 24 and connects with an exterior operator 26 which is operable by a key 28 and/or a handle lever 30. The latch cover 24 encloses split dual latch mechanism, as will be further described. The latch mechanism is a heavy duty dual latch mechanism. The latches 50 project and operate with a double door strike 40 having a cover 42 and a pair of strikes 44.

Figure 5:
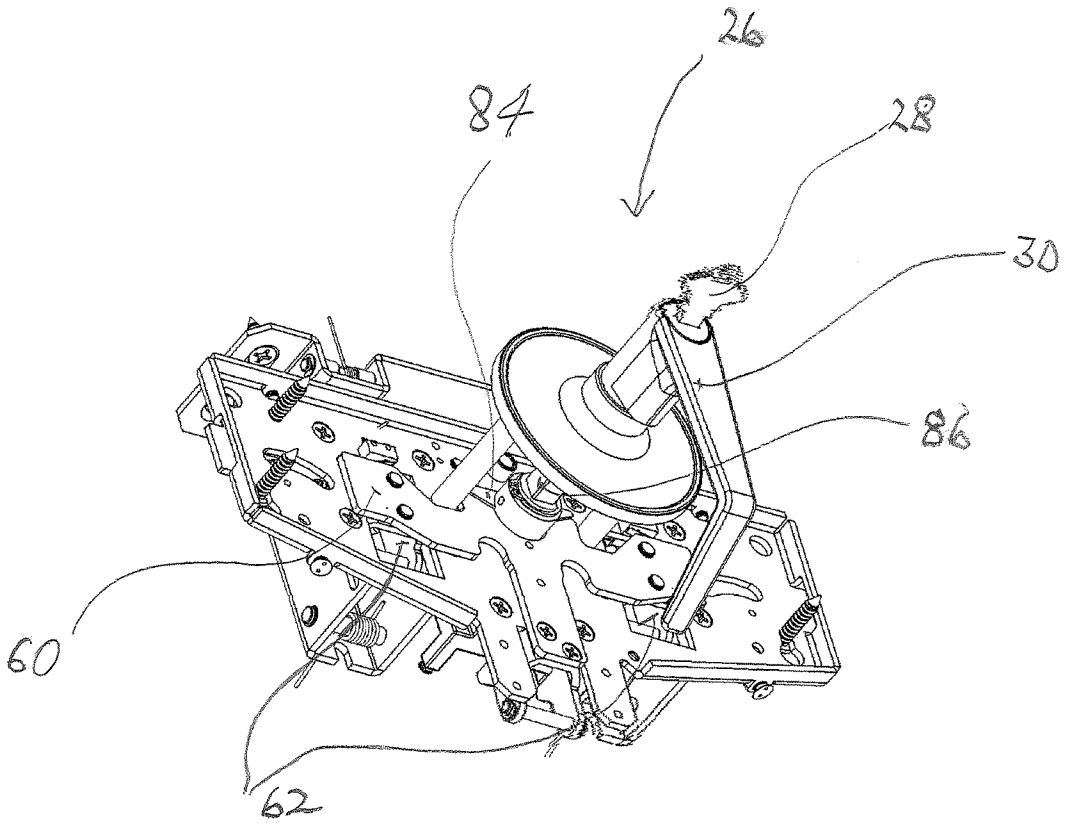
FIG. 5 is a generally opposite perspective view of the rim exit device and strike of FIG. 4.
Figure 6:
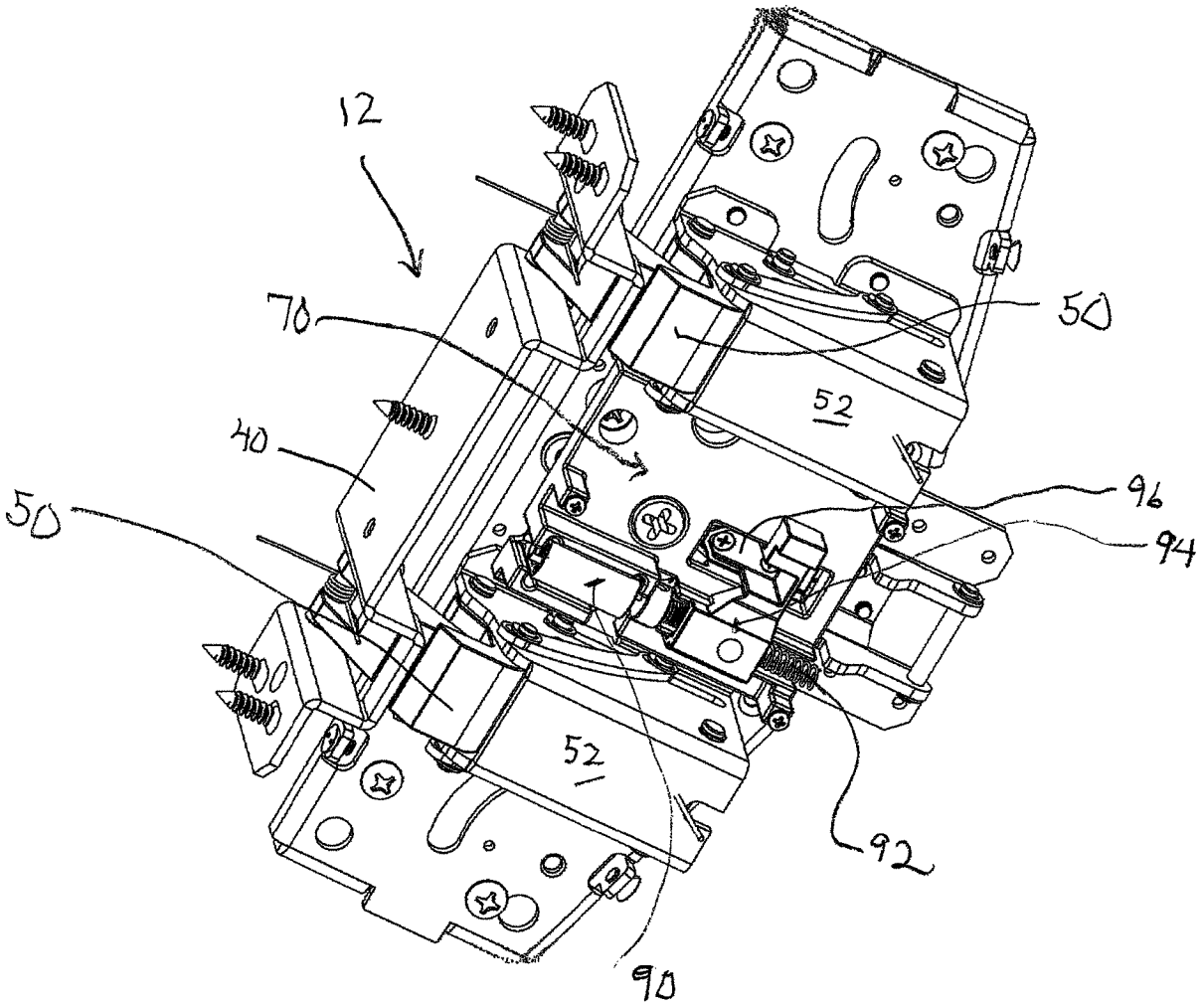
FIG. 6 is a perspective view, portions removed, of a rim exit device and a strike wherein the rim exit device employs a motor-driven locking mechanism.

Two substantially identical retractable latches 50 generally operate in tandem. The latches 50 are biased to project forwardly and are engageable with the double strike 40 when the associated door is closed. A substantially identical cage 52 houses each latch 50 in the retracted position. Each cage has an associated crank arm 54 which, at one end, follows a cam track 56. The crank arms 54 are activatable by a single pull plate 60 (FIG. 5). The pull plate 60 is retracted by depressing the push pad 22. The cages 52 are separated by a central cavity 70 which can be configured in various ways for remote locking and unlocking of the rim exit device.

In one embodiment, a pair of solenoids 72 is mounted in the central cavity. The solenoids 72 are preferably actuatable from a remote location for power retraction of the latches and maintenance of the latches 50 in a retracted position. For some embodiments (not illustrated), only a single solenoid is employed to retract both latches 50.

Figure 4:
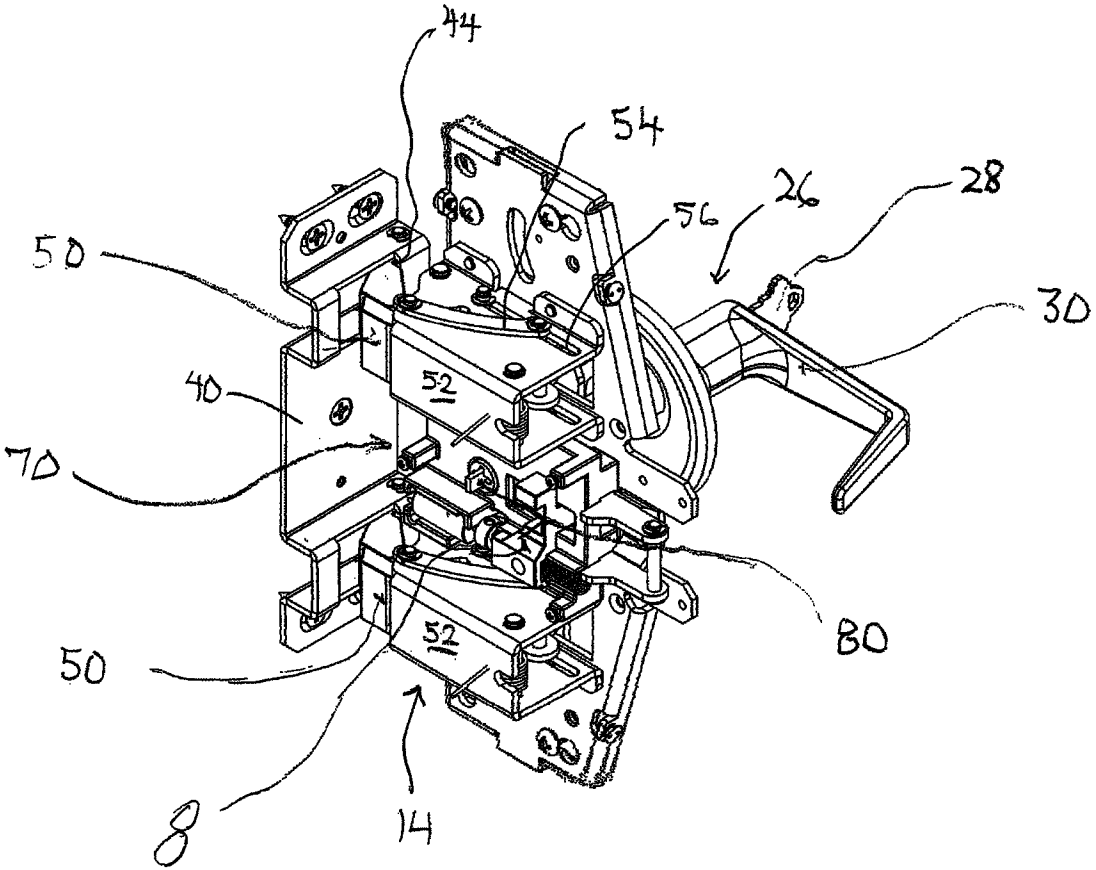
FIG. 4 is an enlarged perspective view of the rim exit device and strike of FIG. 3 with additional portions being removed.

In another embodiment (FIGS. 4 and 5), a motor driven locking mechanism 80 is mounted in the cavity 70 between the cages 52. This embodiment employs an external operator 26 which functions as a mechanical key override assembly controlled by the external key 28. The external operator 26 connects via spindle 86 with the dual latch mechanism.

Figure 7:
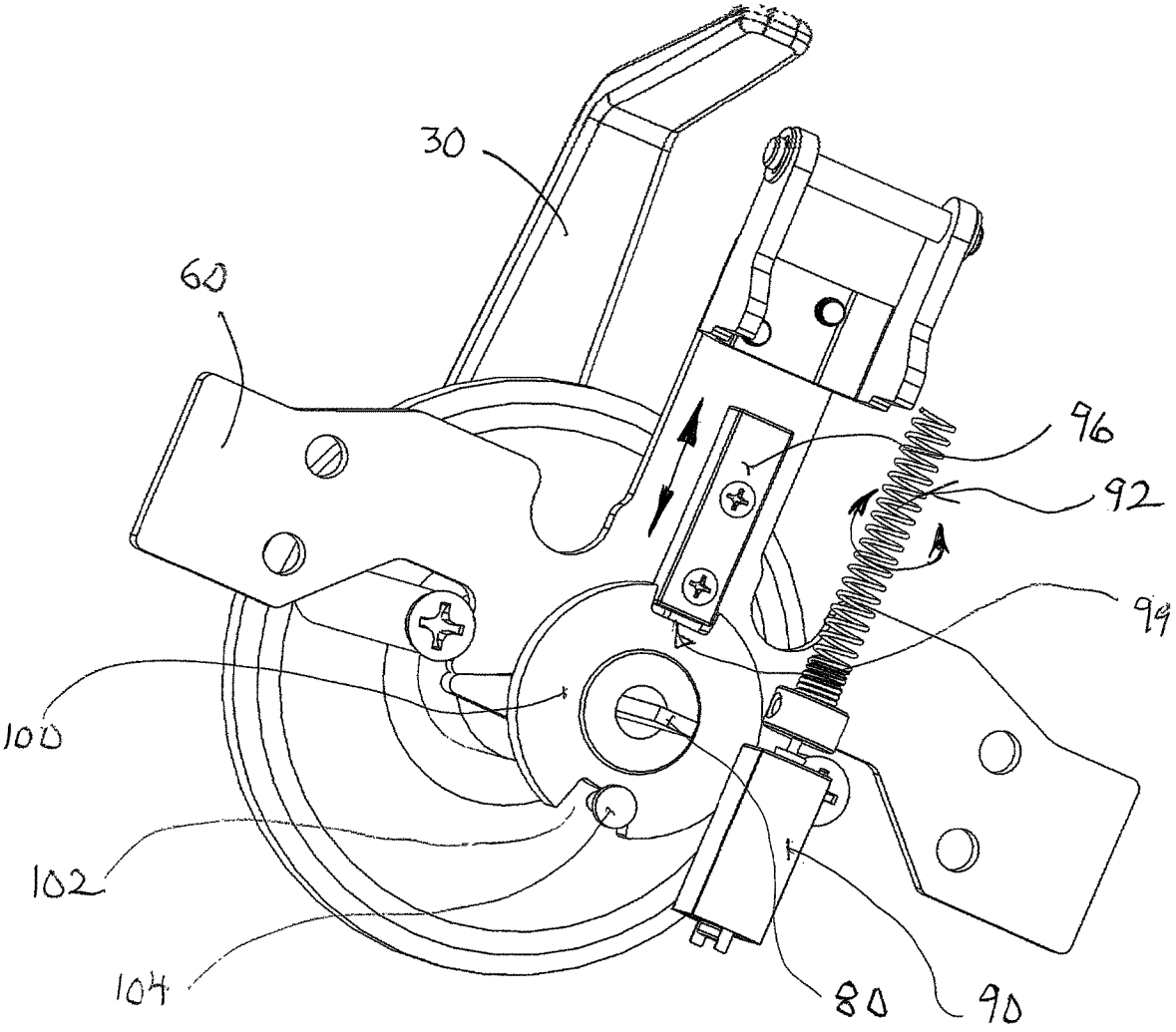
FIG. 7 is an enlarged fragmentary perspective view further illustrating the function of the motor drive to lock or unlock the latch.
Figure 8:
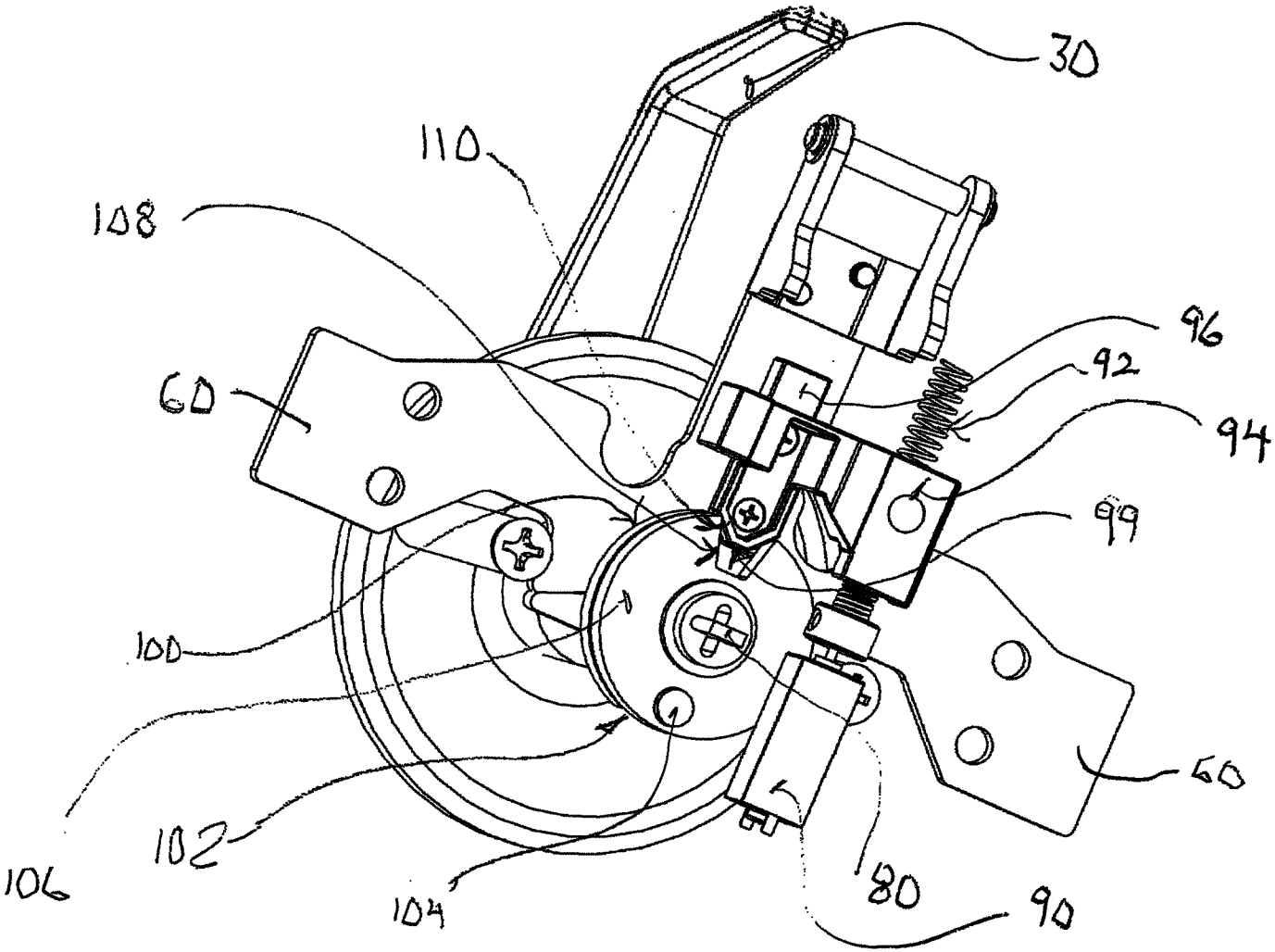
FIG. 8 is an enlarged perspective view, portions removed and with additional parts, further illustrating the key override.
Figure 9:
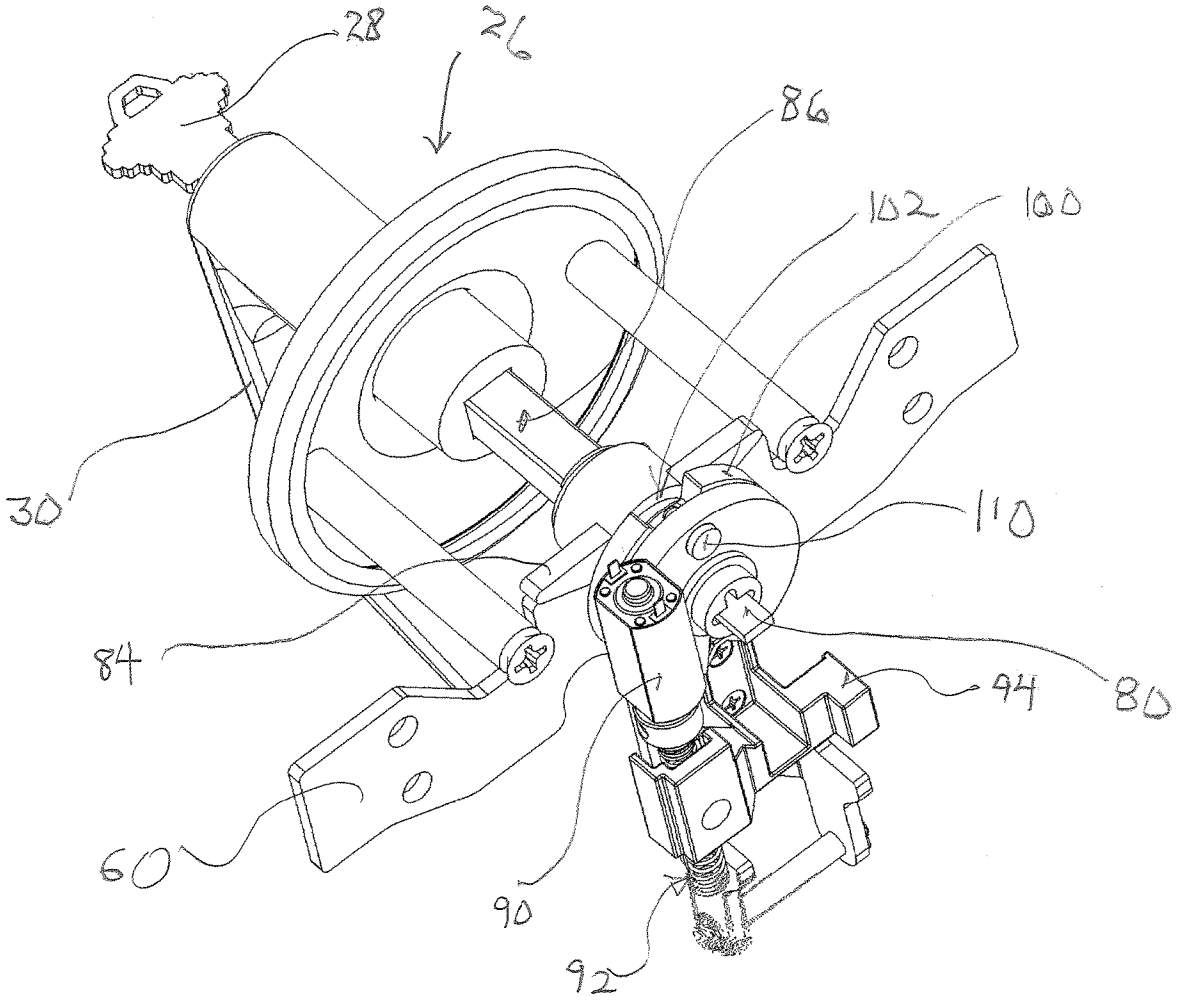
FIG. 9 is a fragmentary perspective view of the portion of FIG. 8, taken from a different viewpoint thereof.
Figure 10:
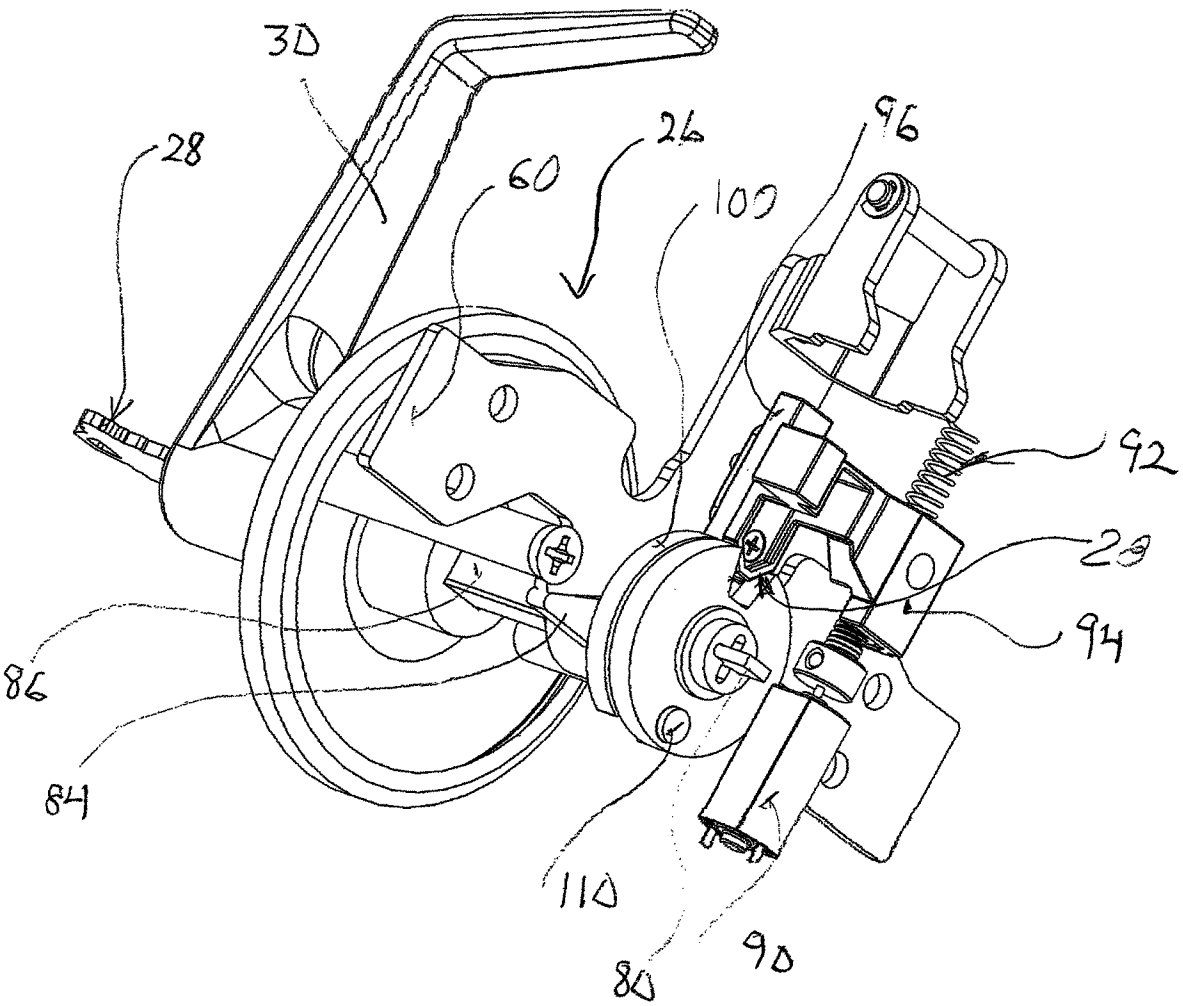
FIG. 10 is an enlarged fragmentary perspective view of the portions of FIG. 9 taken from a different viewpoint thereof.

As best illustrated in FIGS. 5-8, the pull plate 60 attached to the latch pull 62 retracts both the latches 50. When unlocked, the spindle 86 rotates the cam 84 to move the pull plate 60 to thereby retract the latches. The motor 90 couples to a spring drive 92 and a locking slide 94 which has a locking pin 96. The locking pin 96 is receivable in a locking slot 99 of a locking disk 100 which connects with the spindle 86 and an override slot 102 via an override pin 104 and an override blade 80. The locking and unlocking is implemented when the motor drive 90 pushes the locking pin 96 into the locking slot 99 or retracts it from the locking slot, as shown in FIG. 7.

An override disk 106 is driven by the override blade 80 and is free to rotate as much as allowed by the locking disk override pin 104 to travel in the override slot 102. That free rotation allows the override cam 108 with follower 110 which is built into the locking slide 94 to push out the locking pin 96 attached to the locking slide 94. Afterward, the locking pin 96 is free to be rotated along with the attached spindle 86 by the key 28 override and/or by the lever 30.

Figure 11:
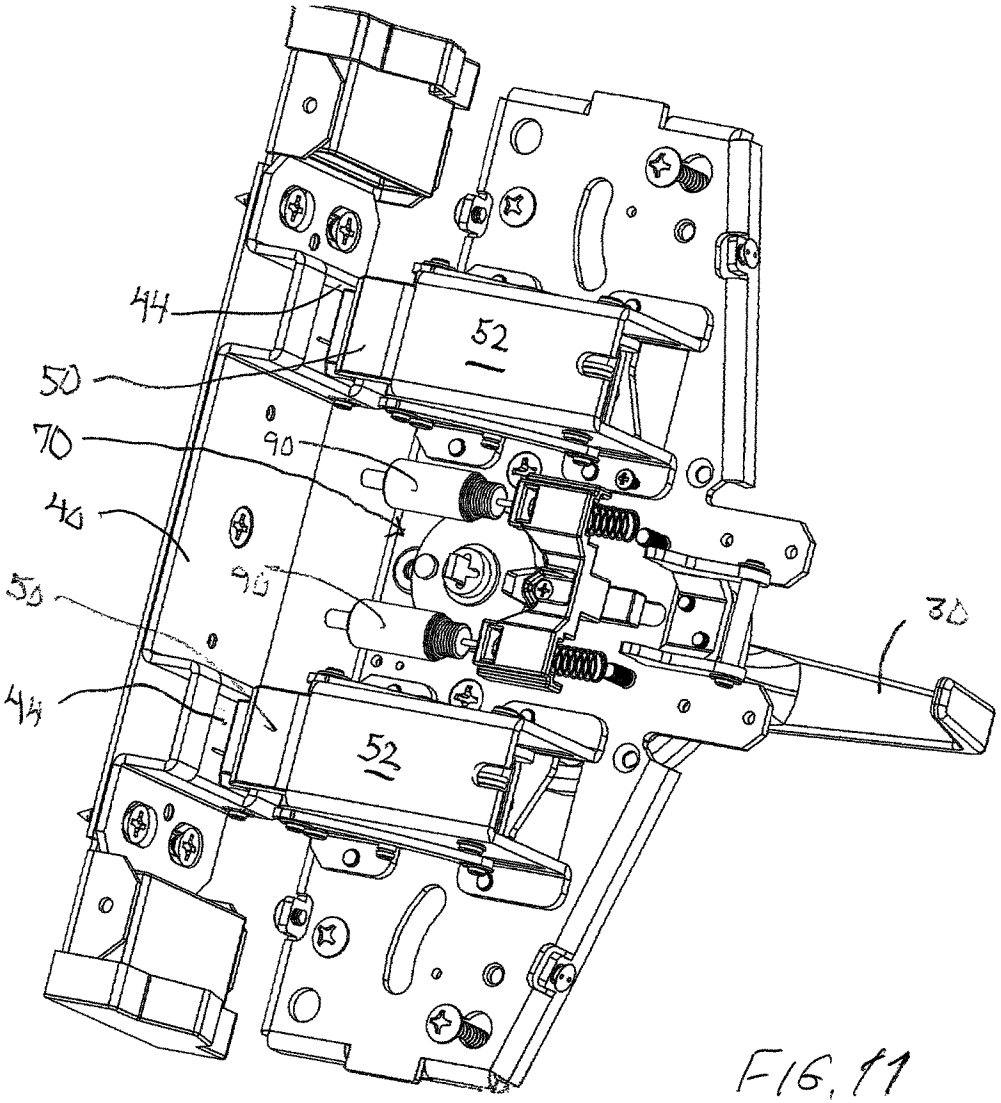
FIG. 11 is a fragmentary perspective view, portions removed, of a rim exit device and strike further illustrating a solenoid-driven locking function.

The foregoing locking function can also be driven by solenoids 90, as illustrated in FIG. 11.

Figure 12:
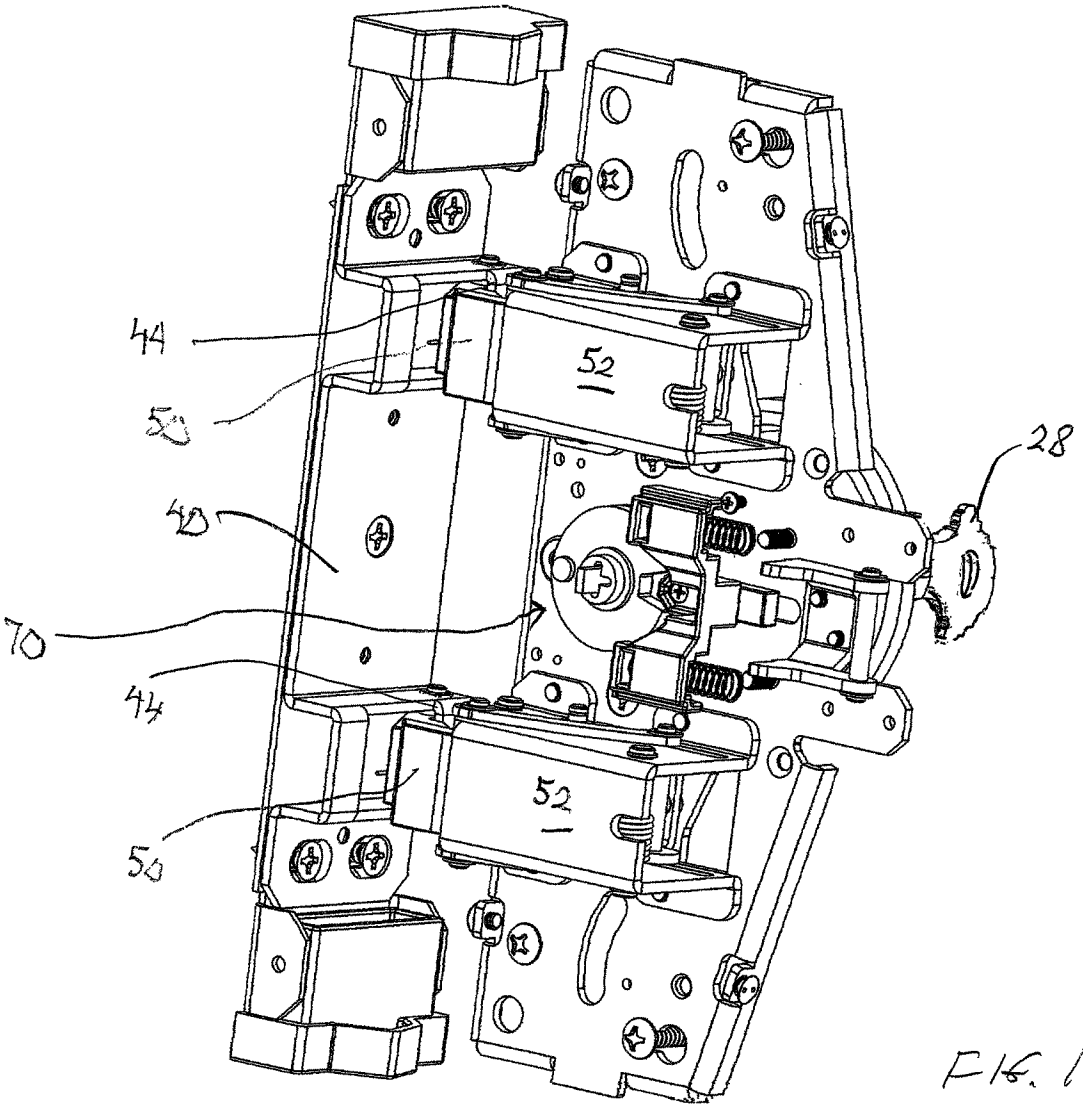
FIG. 12 is an enlarged perspective view, portions removed, of a rim exit device and a strike and further illustrating a device which does not employ a handle, but only employs a key to provide for mechanical locking.

In some embodiments, such as illustrated in FIG. 12, an exterior handle is not required, merely a key. In this embodiment, a single function locking mechanism is employed.

For some embodiments, (not illustrated), the rim exit device may be coordinated with local bar controls. In addition, the motor and/or solenoids may be powered by batteries mounted within the exit device.

While preferred embodiments of the foregoing rim exit device and installation have been set forth for purposes of illustration, the foregoing descriptions should not be deemed a limitation of the invention herein. Accordingly, various modifications, adaptations and alternatives may occur to one skilled in the art without departing from the spirit and the scope of the present invention.

The invention claimed is:

1. An exit device comprising:

a push bar adapted for mounting to an interior side of an exit door and having a depressible push pad which retracts a pull plate when depressed;

a pair of projectable and retractable latches at least partially mounted in a housing and separated by a central cavity, each latch having a crank arm following a cam track, each crank arm being activatable to retract a respective one of said latches by the retraction of the pull plate when the push pad is depressed, thereby causing the latches to be retracted;

a locking disk connected to a cam and having a locking slot and an override slot;

a double strike mountable to a frame of the exit door and engageable by said latches, when said latches are projected to retain the exit door in a latched position;

a latch actuator comprising a remotely controlled device operatively connected to a locking slide having a locking pin and mounted in said central cavity, said locking slide is actuatable to allow said latches to be retracted through actuation of an exterior operator by retracting the locking pin from the locking slot of the locking disk, wherein said exterior operator is mountable to an exterior side of said exit door and is connectable to said locking disk and said cam via a spindle such that the actuation of the exterior operator rotates said cam to retract the pull plate, thereby retracting the latches.

2. The exit device of claim 1 wherein said remotely controlled device comprises a motor coupled to a spring device which is actuatable from a remote location.

3. The exit device of claim 1 wherein said remotely controlled device is a solenoid.

4. The exit device of claim 1 wherein said remotely controlled device comprises a pair of solenoids.

5. An exit door installation comprising:

a door frame and an exit door having an exterior side and an interior side and;

an exit door latching assembly comprising:

a push bar mounted to the interior side of the exit door and having a depressible push pad which retracts a pull plate;

a pair of projectable and retractable latches at least partially mounted in a housing and separated by a central cavity, each latch having a crank arm activatable to retract said latch by a retraction of the pull plate when said push pad is depressed, thereby causing said latches to be retracted;

a locking disk connected to a cam and having a locking slot and an override slot;

a double strike mounted to the frame of the exit door and engageable by said latches, when said latches are projected, to retain the exit door in a latched position;

a latch actuator comprising a remotely controlled device operatively connected to a locking slide having a locking pin and mounted in said central cavity, said locking slide being actuatable to allow said latches to be retracted through actuation of an exterior operator by retracting the locking pin from the locking slot of the locking disk, wherein said exterior operator is mounted to the exterior side of said exit door and is connectable through the exit door to said locking disk and said cam via a spindle such that the actuation of the exterior operator rotates said cam to retract the pull plate, thereby retracting the latches.

6. The exit device of claim 5 wherein said remotely controlled device comprises a motor coupled to a spring device which is actuatable from a remote location.

7. The exit device of claim 5 wherein said remotely controlled device comprises a solenoid.

8. The exit device of claim 5 wherein said remotely controlled device comprises a pair of solenoids.

* * * * *